US006311852B1

(12) United States Patent
Ireland

(10) Patent No.: US 6,311,852 B1
(45) Date of Patent: Nov. 6, 2001

(54) MERCHANDISING FIXTURE AND SHELF DIVIDER SYSTEM THEREFOR

(75) Inventor: David S. Ireland, Akron, OH (US)

(73) Assignee: Darko Company, Inc., Twinsburg, OH (US)

( * ) Notice: Subject to any disclaimer, the term of this patent is extended or adjusted under 35 U.S.C. 154(b) by 0 days.

(21) Appl. No.: 09/379,251

(22) Filed: Aug. 23, 1999

(51) Int. Cl.[7] ..... A47F 1/04
(52) U.S. Cl. ..... 211/59.2; 211/184
(58) Field of Search ..... 211/59.2–59.4, 211/184, 43, 74, 85.18, 51; 206/561; 108/60–61; 220/532–533

(56) References Cited

U.S. PATENT DOCUMENTS

| | | | | |
|---|---|---|---|---|
| 1,560,436 | * | 11/1925 | Staples | 211/59.2 |
| 3,427,084 | * | 2/1969 | Sinclair | 211/184 |
| 4,454,948 | * | 6/1984 | Spamer | 211/49.1 |
| 4,488,653 | * | 12/1984 | Belokin | 211/184 |
| 4,519,508 | * | 5/1985 | Gullett et al. | 211/59.2 |
| 4,728,158 | * | 3/1988 | D'Elia et al. | 211/184 |
| 4,775,058 | * | 10/1988 | Yatsko | 211/184 |
| 4,960,210 | * | 10/1990 | Spamer | 211/59.2 |
| 5,022,535 | * | 6/1991 | Spamer | 211/59.2 |
| 5,181,623 | * | 1/1993 | Linden et al. | 211/183 |
| 5,199,584 | * | 4/1993 | Fowler et al. | 211/59.2 |
| 5,255,802 | * | 10/1993 | Krinke et al. | 211/184 |
| 5,353,714 | * | 10/1994 | Hardy | 211/184 |
| 5,411,146 | * | 5/1995 | Jarecki et al. | 211/59.2 |
| 5,437,380 | * | 8/1995 | Peay et al. | 211/184 |
| 5,577,623 | * | 11/1996 | Bustos | 211/187 |
| 5,638,963 | * | 6/1997 | Finnelly et al. | 211/59.3 |
| 5,673,801 | * | 10/1997 | Markson | 211/184 |
| 5,740,926 | * | 4/1998 | Mulloy | 211/43 |
| 5,749,478 | * | 5/1998 | Ellis | 211/59.2 |
| 5,772,046 | * | 6/1998 | Tercher et al. | 211/184 |
| 6,006,678 | * | 12/1999 | Merit et al. | 211/184 |

OTHER PUBLICATIONS

Fasteners For Retail, Inc. "Your Supporting Cast of Display Accessories" brochure excerpt, p. 64 (1996).

* cited by examiner

*Primary Examiner*—Daniel P. Stodola
*Assistant Examiner*—Jennifer E. Novosad
(74) *Attorney, Agent, or Firm*—Renner, Kenner, Greive, Bobak, Taylor & Weber

(57) ABSTRACT

A fixture (10) for displaying merchandise such as cans (C) includes shelves (15) having slots (17) in their upper surface (16). A plurality of inserts (20) divides the shelves (15) into rows of merchandise receiving areas. The inserts (20) each include a base member (21) having a tab (22) in one embodiment, and a plurality of tabs (22, 26) in another embodiment, each adapted to be received in a slot (17). A divider strip extending upwardly from the base member (21), and rails (25) extending upwardly from the base member (21) at its lateral edges. The rails (25) of adjacent inserts (20) provide a surface on which the cans (C) may rest, and the shelves (15) may be inclined so that the cans (C) may slide on the rails (25) toward the front of the shelves (15). A bracket (27) is mounted at the front of the shelves (15) to keep the cans (C) on the shelves (15), and the bracket can carry an indicia displaying insert (35) therein.

14 Claims, 3 Drawing Sheets

MERCHANDISING FIXTURE AND SHELF DIVIDER SYSTEM THEREFOR

TECHNICAL FIELD

This invention relates to a fixture for displaying merchandise for retail sale. More particularly, this invention relates to a system of dividing the shelf of the fixture into separate areas for the merchandise. In addition, for fixtures having shelves that are inclined, this invention relates to a bracket which can display indicia regarding the merchandise while at the same time confining the merchandise on the inclined shelves.

BACKGROUND ART

When displaying merchandise for sale on the shelf of a fixture, it is often desirable to divide the shelf into discrete areas so that, for example, certain merchandise can be kept segregated from different merchandise, if desired. Of course, merchandise comes in many sizes and shapes and thus a permanent shelf dividing system is not practical since it could not be universally used for all merchandise. One solution to this problem in the past has been to provide a shelf with slots therein and then insert strips of material in selected of those slots with the space between the strips defining the discrete area for the merchandise. However, such strips were flimsy and if bumped, could often become dislodged from the shelf. Moreover, for those shelves that are inclined to allow the merchandise to slide down the shelf when the front item of a row of merchandise was taken by a customer, such a system was unworkable because the merchandise would not readily slide on the slotted shelf.

As a potential solution to these problems, it was proposed to put stabilizing wings on the shelf dividing strips which would extend into the discrete divided area and deter the accidental dislodging of the strips. While such a system helped to solve the dislodging problem, the merchandise for inclined shelves was still required to slide on these wings and the friction occasioned thereby impeded such sliding.

Thus, the need exists for a shelf dividing system for a merchandise display fixture which is stable and which can be used in the environment of an inclined shelf allowing the merchandise to readily slide to the front of the shelf to be stopped by a bracket having indicia-carrying capabilities.

DISCLOSURE OF THE INVENTION

It is therefore an object of the present invention to provide a merchandise display fixture with a shelf dividing system whereby the shelf can be divided into discrete areas of a desired size.

It is another object of the present invention to provide a shelf dividing system, as above, which is stably maintained on the shelf.

It is a further object of the present invention to provide a shelf dividing system, as above, which can be utilized with an inclined shelf which allows the merchandise to slide down the shelf.

It is an additional object of the present invention to provide a shelf dividing system, as above, with a unique front bracket which maintains the divided merchandise on the inclined shelf and which has the capability of carrying messages thereon regarding the merchandise.

These and other objects of the present invention, as well as the advantages thereof over existing prior art forms, which will become apparent from the description to follow, are accomplished by the improvements hereinafter described and claimed.

In general, a shelf dividing system made in accordance with the present invention includes a shelf having an upper surface which is interrupted by a plurality of spaced slots. The system also includes at least two inserts which are positionable in selected of the slots thereby being adjacent to each other to define a merchandise receiving area therebetween. The inserts each have rails such that the merchandise may be positioned on the opposed rails of the adjacent inserts.

A fixture for displaying merchandise includes a shelf having a back edge higher than a front edge so that merchandise on the shelf can slide toward the front edge. A bracket is mounted at the front edge of the shelf to stop the sliding movement of the merchandise and to provide a means to display indicia regarding the merchandise positioned on the shelf.

In accordance with another aspect of the present invention, a divider is provided for a shelf which has an upper surface interrupted by a plurality of spaced slots. The divider includes a base member having at least one tab extending downwardly therefrom which is adapted to be received in a slot of the shelf. The base member thereby rests on the upper surface of the shelf when the tab is in the slot. A shelf dividing strip extends upwardly from the base member, and rails likewise extend upwardly from the base member and are spaced from the dividing strip.

A preferred exemplary merchandising display fixture and shelf divider incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENTS FOR CARRYING OUT THE INVENTION

Figure 1:
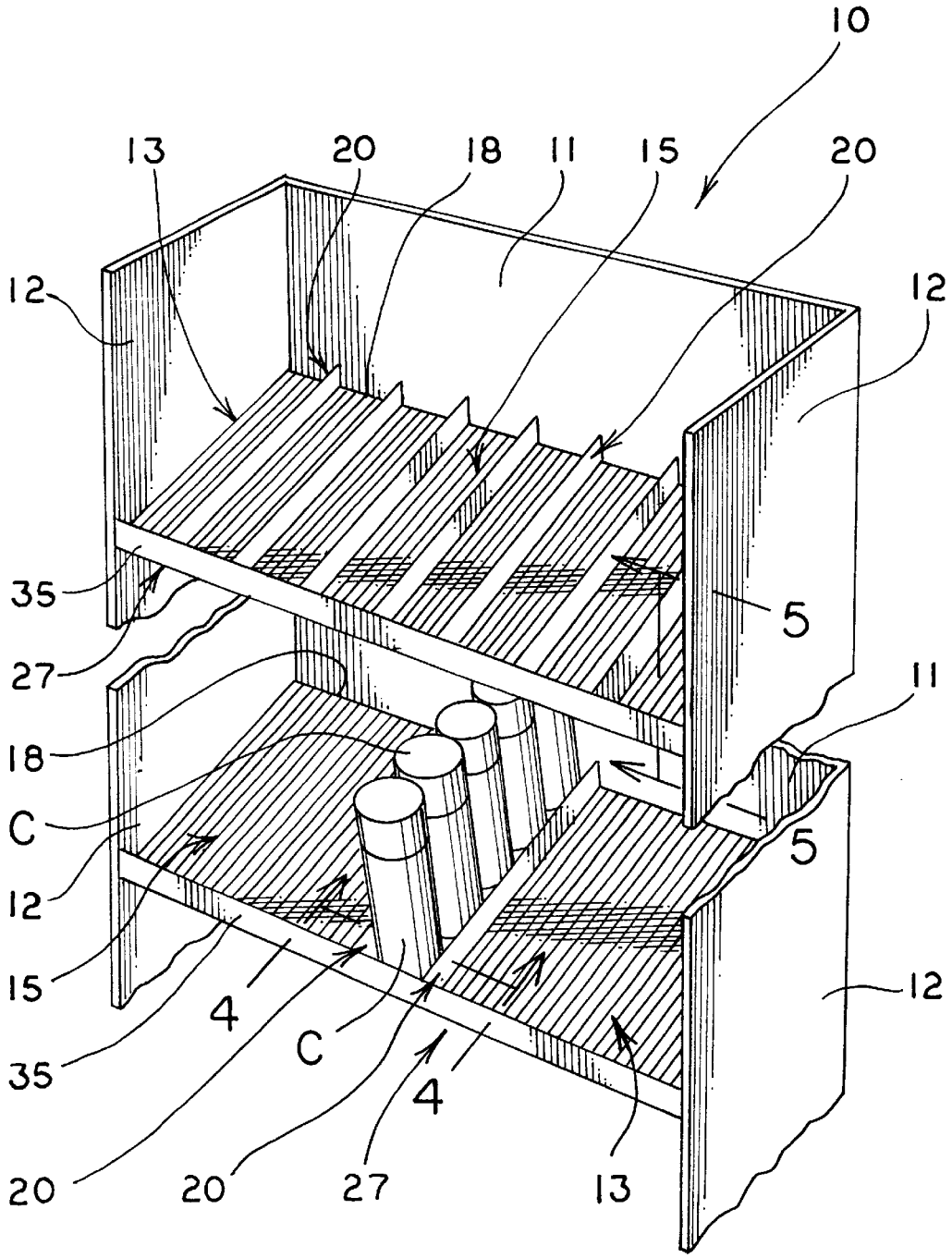
FIG. 1 is a somewhat schematic, fragmented, perspective view of a merchandising display fixture and shelf divider system made in accordance with the concepts of the present invention.

A fixture to display merchandise is shown in FIG. 1 and is generally indicated by the numeral 10. The specific configuration of fixture 10 is not at all important to the present invention with the specific fixture 10, schematically shown, merely being typical of any conventional merchandise display fixture. Fixture 10 can be of any suitable height and includes a rear wall 11 with spaced side walls 12 extending forwardly therefrom. The front of fixture 10 is open to expose a plurality of shelf assemblies generally indicated by the numeral 13. Fixture 10 is shown in FIG. 1 as having two such shelf assemblies 13, but it should be evident that such fixtures would include several shelf assemblies positioned above each other and would be of a height so that the top shelf was in reach of the average sized consumer.

Figure 4:
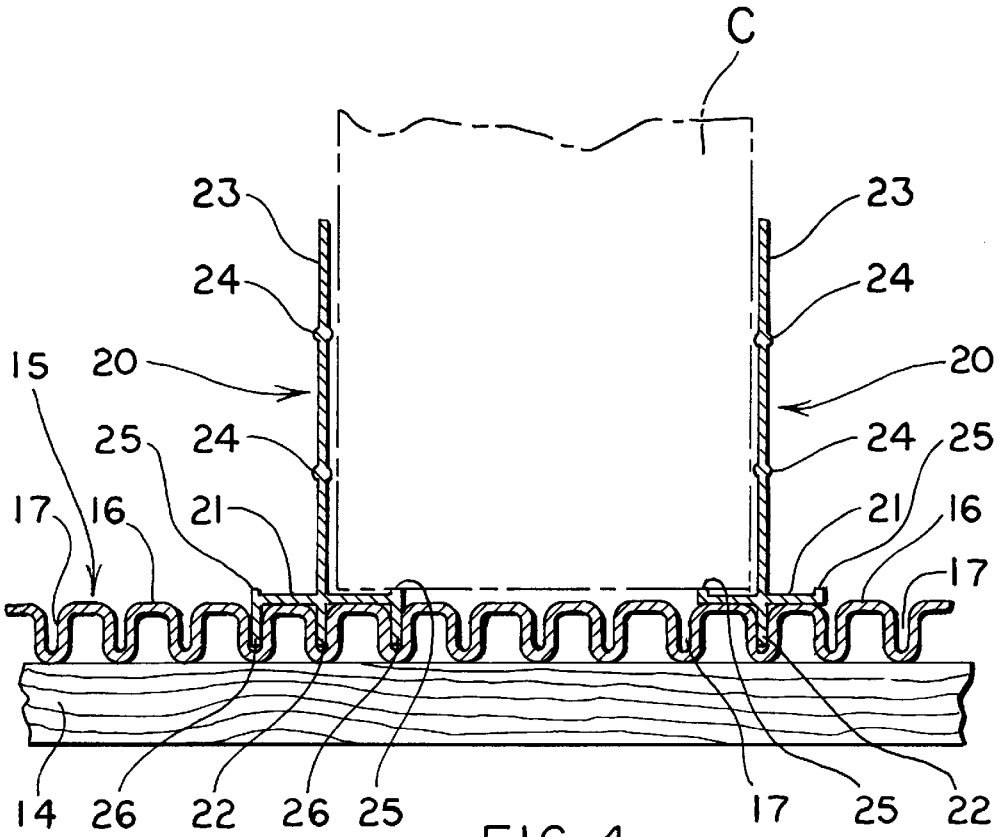
FIG. 4 is a fragmented, sectional view taken substantially along line 4—4 of FIG. 1.

As perhaps best shown in FIG. 4, each shelf assembly 13 preferably, but not necessarily, includes a shelf substrate 14 which could be made of any suitable material and which is attached between fixture rear wall 11 and side walls 12. Substrate 14 provides strength to a shelf, generally indicated by the numeral 15, positioned thereon. As a result, shelf 15 may be inexpensively vacuum formed of a styrene or like plastic material. However, if shelf 15 were formed of a more durable material, shelf substrate 14 could be eliminated. Each shelf 15 is shown as having an upper, generally flat, surface 16 interrupted by regularly spaced slots 17 formed thereon. Slots 17 extend from the back edge 18 of shelf 15 to the front edge 19 thereof (FIG. 5) and when positioned in fixture 10, slots 17 thus extend from rear wall 11 of fixture 10 to the open front thereof.

Figure 2:
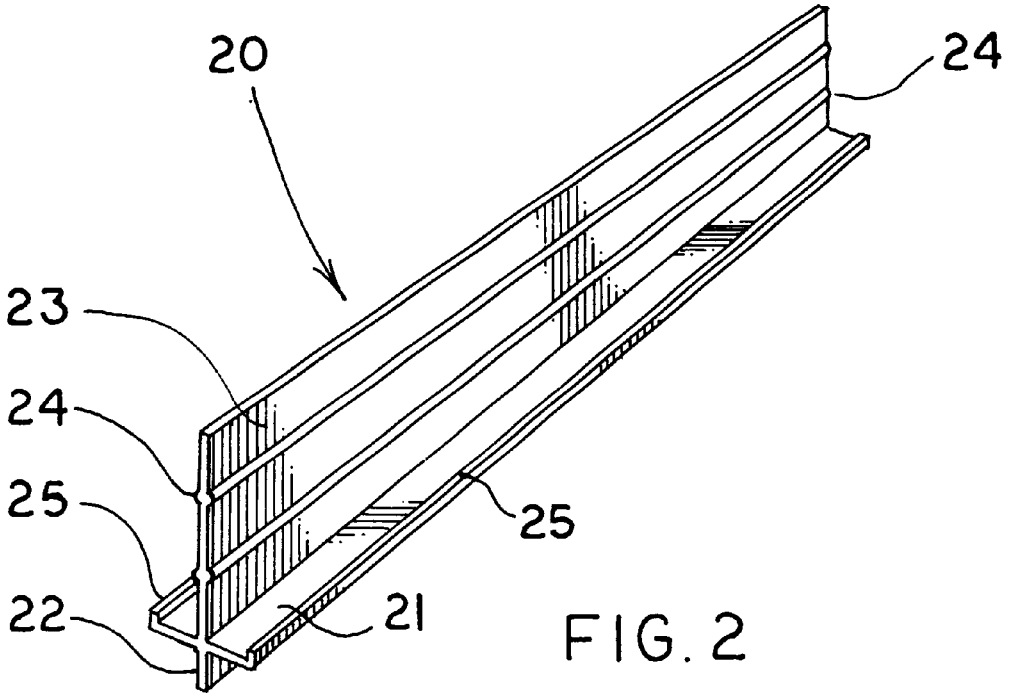
FIG. 2 is a perspective view of a shelf divider made in accordance with the concepts of the present invention.

Shelves 15 are adapted to receive a plurality of shelf divider inserts, one embodiment of which is shown in FIG. 2 and generally indicated by the numeral 20. Inserts 20 are preferably extruded from a styrene or like plastic material, and as shown in FIG. 2, each insert 20 includes a generally horizontal elongate base member 21 having an elongate tab 22 extending downwardly therefrom and generally centrally thereof. A divider strip 23 also runs the length of base member 21 and extends upwardly therefrom at a point on base member 21 preferably opposite to that of tab 22. In order to inexpensively manufacture insert 20, strip 23 may, as necessary, be provided with one or more stiffening ribs 24 extending along the length thereof. Upwardly extending rails 25 are also formed at the lateral edges of base member 21 which, as will hereinafter be described, offer an almost frictionless surface on which to position an article of merchandise.

Dependent on the size (width) of the merchandise being displayed on fixture 10, as shown in FIG. 1, inserts 20 can be positioned in selected slots 17 of shelves 15 to divide shelves 15 into a plurality of discrete merchandise receiving areas. Thus, items of merchandise, such as cans of spray paint C, can be positioned in rows between adjacent inserts 20. For ease of depiction, FIG. 1 shows the top shelf 15 as having a plurality of inserts 20 positioned therein defining several discrete areas or rows, each of which would receive items such as cans C, and, for example, each row might confine a can C of a different color paint. Also for ease of depiction, FIG. 1 shows a lower shelf 15 with one set of adjacent divider inserts 20 defining an area for a row of cans C, it being understood that in actual practice the retailer would use enough inserts 20 as necessary to enable him to fill all shelves 15 with merchandise.

Figure 3:
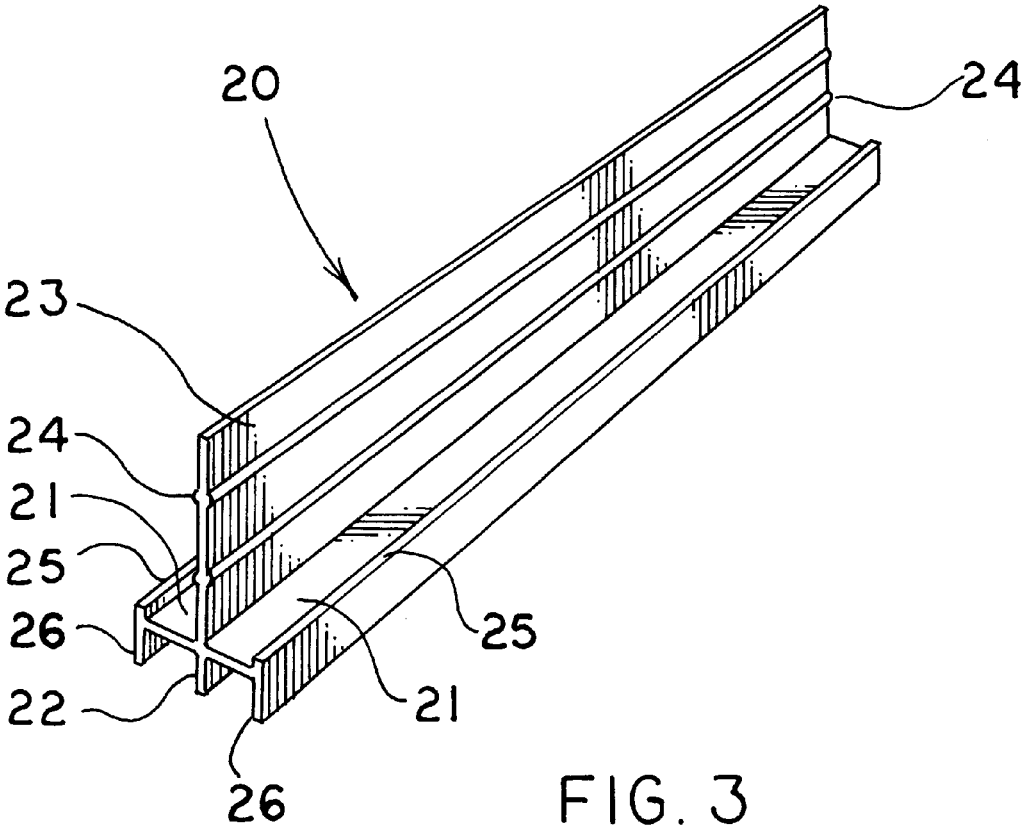
FIG. 3 is a perspective view of an alternative embodiment of a shelf divider made in accordance with the concepts of the present invention.

An alternative embodiment of insert 20 is shown in FIG. 3. In most all respects, insert 20 of FIG. 3 is identical to that shown in FIG. 2, and thus the same references numerals 21–25 are used in FIG. 3 to identify the same structure as shown in FIG. 2, and previously described. However, in the embodiment of FIG. 3, base member 21 is somewhat wider so that it generally overhangs the slots 17 adjacent to the slot 17 in which tab 22 is positioned. The lateral edges of this base member 21 are then each provided with a downwardly directed tab 26 to be received in the slots adjacent to the slot in which tab 22 is positioned. Such provides an even more stable shelf dividing system in that the divider 20 of FIG. 3 provides three tabs positioned in slots 17. Of course, it is contemplated that by using tabs 26 at the lateral edges of base member 21, central tab 22 may even be eliminated in some applications.

For convenience of illustration, FIG. 4 shows one divider 20 in accordance with FIG. 2 and one divider 20 in accordance with FIG. 3 being installed on a shelf 15, it being understood that in at least most instances, a shelf assembly 13 would normally be provided with identical dividers 20 dependent on the application. That is, if the merchandise were such that extremely stable dividers would be preferred, those of FIG. 3 would be provided.

While the shelf assemblies 13 just described are entirely suitable for horizontal shelves, such are particularly suited for inclined shelves such as shown in FIG. 1. In such circumstances, shelves 15 and their substrates 14 are positioned so that their back edges 18 are positioned higher than their front edges 19 so that when a consumer selects the front can C from a row of cans, the remaining cans C in the row will slide down the shelf. Such is particularly accommodated because, as shown in FIG. 4, the bottom of cans C is engaged only by the opposed rails 25 of adjacent inserts 20. As such, there is very little surface-to-surface contact, and the merchandise can readily slide on these rails 25 with minimal frictional resistance.

In the instance of such an inclined shelving system, however, means must be provided to prevent the merchandise from sliding off the front of shelves 15. While typically any type of front bar may be provided, the present invention contemplates the use of a unique bracket generally indicated by the numeral 27.

Figure 5:
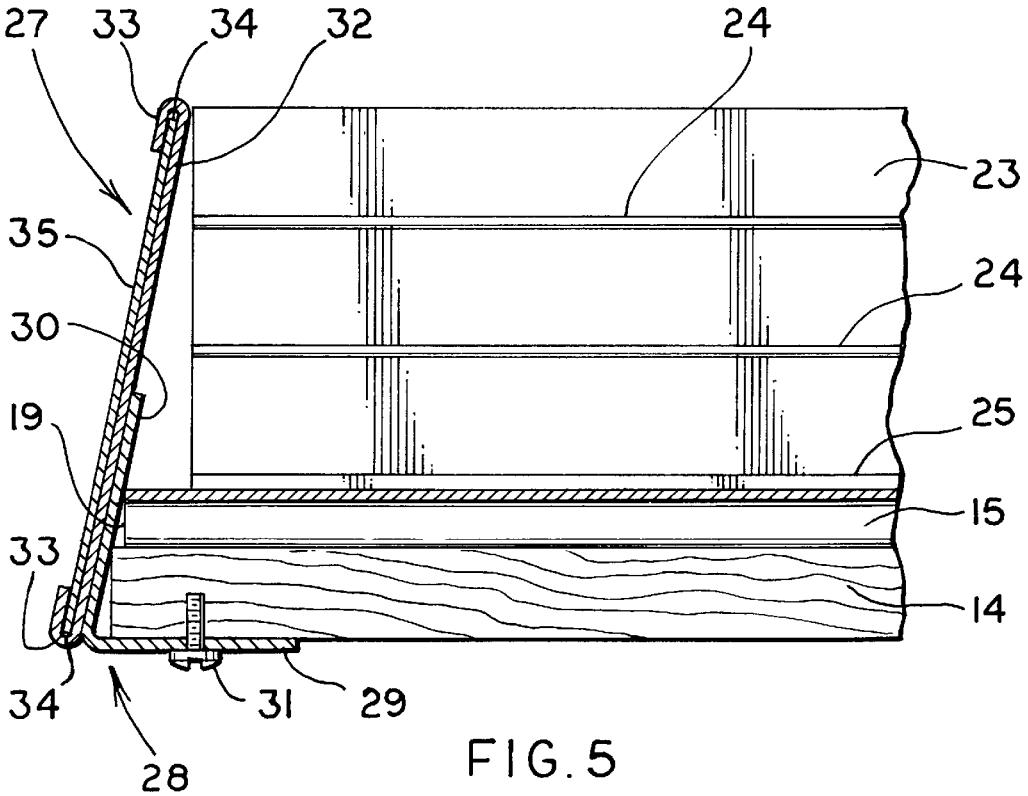
FIG. 5 is a fragmented, sectional view taken substantially along line 5—5 of FIG. 1.

As best shown in FIG. 5, bracket 27 includes an angle member, generally indicated by the numeral 28, which includes a generally horizontal leg 29 and a leg 30 upwardly extending from leg 29 at an acute angle thereto. Leg 30 may be attached to the bottom of shelf substrate 14 by a plurality of fasteners 31 (one shown). Leg 30 carries a channel plate 32 having curved ends 33 thereby forming opposed slots 34. Leg 30 may be attached to plate 32 by any suitable means, but since angle member 28 and plate 32 are preferably made of a metallic material, spot welding is the preferred form of attachment. Channel plate 32 is thus situated on the same angle to horizontal as is leg 30 of angle member 28.

As shown in FIG. 5, one side of channel plate 32 is adapted to provide a stop surface for cans C and the other side is adapted to receive a display insert 35, preferably of a paper board stock material. As such, insert 35 may be slid into the channel formed by opposed slots 34 and retained therein by curved ends 33. Insert 35 is provided to display written information or other indicia regarding the merchandise being displayed on a shelf assembly 13. For example, the indicia could promote a sale, or identify the price or other information about the product such as the colors of paint in the rows of cans C. Such indicia is readily viewable by the consumer because of the angle formed by angle member 28.

In view of the foregoing, it should be evident that a merchandising display fixture and shelf dividing system constructed as described herein substantially improves the art and otherwise accomplishes the objects of the present invention.

What is claimed is:

1. A shelf dividing system comprising a shelf having an upper surface, said upper surface being interrupted by a plurality of spaced slots, and at least two inserts, each said insert including a base member having lateral edges, a first tab extending downwardly from near one of said lateral edges, a second tab extending downwardly from near another one of said lateral edges, and a third tab extending downwardly from said base member, each said tab being adapted to be positioned in one of said slots, each said insert being adapted to be positioned adjacent to each other to define a merchandise receiving area therebetween, said inserts each having rails such that merchandise may be positioned on opposed rails of said adjacent inserts.

2. A shelf dividing system according to claim 1, said rails being positioned near said lateral edges of said base member and extending upwardly therefrom.

3. A shelf dividing system according to claim 1, said base member being adapted to rest on said upper surface when said tabs are in said slots.

4. A shelf dividing system according to claim 1, each said insert including a divider strip extending upwardly from said base member said divider strip of one said insert defining, with said divider strip of said adjacent insert, a merchandise receiving area.

5. A shelf dividing system according to claim 4, said divider strip having stiffening ribs.

6. A shelf dividing system comprising a shelf having an upper surface, said shelf being inclined downwardly from back to front, said upper surface being interrupted by a plurality of spaced slots, at least two inserts, each said insert having lateral edges, a first tab extending downwardly from said insert and adapted to be positioned in one of said slots, and a tab extending downwardly from each of said lateral edges adapted to be positioned in selected ones of said slots, said inserts being positionable adjacent to each other to define a merchandise receiving area therebetween, said inserts each having rails such that merchandise may be positioned on opposed rails of said adjacent inserts and move toward the front of said shelf, a shelf substrate carrying said shelf, and a bracket mounted at the front of said shelf, said bracket including a generally flat plate extending upwardly from said shelf, one side of said plate maintaining merchandise on said shelf and the opposite side of said plate being formed as a channel, a display insert being positionable in said channel, said bracket also including an angle member having a first leg attached to said substrate and a second leg extending from said first leg and carrying said plate.

7. A shelf dividing system according to claim 6, said plate having curved ends forming slots to receive said display insert.

8. A fixture for displaying merchandise comprising at least one shelf having a back edge and a front edge with a plurality of slots extending from said back edge to said front edge, said back edge being higher than said front edge so that merchandise on said shelf can slide by gravity toward said front edge; at least two inserts, each said insert including a base member having lateral edges, a first tab extending downwardly from said base member and adapted to be positioned in one of said slots, and a tab extending downwardly from each of said lateral edges adapted to be positioned in selected ones of said slots; a bracket mounted at said front edge of said shelf; and a shelf substrate carrying said shelf; said bracket including a generally flat plate extending upwardly from said shelf, one side of said plate being adapted to stop the sliding movement of merchandise, the opposite side of said plate being formed to receive an insert to display indicia regarding merchandise positioned on said shelf; said bracket also including an angle member having a first leg attached to said substrate and a second leg extending from said first leg and carrying said plates.

9. A fixture according to claim 8 wherein said opposite side of said plate includes a channel, said insert being received in said channel.

10. A fixture according to claim 9, said opposite side of plate having curved ends forming slots to define said channel and receive said insert.

11. A fixture according to claim 8 further comprising a rail positioned near each lateral edge and extending upwardly therefrom, the merchandise being positionable on opposed rails of adjacent inserts.

12. A fixture according to claim 11, each said insert including a divider strip extending upwardly from said base member, said divider strip of one said insert defining, with said divider strip of said adjacent insert, a merchandise receiving area.

13. A divider for a shelf having an upper surface interrupted by a plurality of spaced slots, the divider comprising a base member having lateral edges, a first tab extending downwardly from said base member and adapted to be received in a slot of a shelf, a second tab extending downwardly from each said lateral edge and adapted to be received in one of said slots, said base member being adapted to rest on the upper surface of the shelf when said first tab and said second tabs are received in the slots, a shelf dividing strip extending upwardly from said base member, and rails extending upwardly from said base member, said rails being spaced from said dividing strip.

14. A divider according to claim 13 wherein said first tab extends downwardly from said base member beneath said strip and into one of said slots.

* * * * *